United States Patent [19]

Bornhorst

[11] Patent Number: 4,800,474

[45] Date of Patent: Jan. 24, 1989

[54] COLOR WHEEL ASSEMBLY FOR LIGHTING EQUIPMENT

[75] Inventor: James M. Bornhorst, Duncanville, Tex.

[73] Assignee: Vari-Lite, Inc., Dallas, Tex.

[21] Appl. No.: 863,440

[22] Filed: May 15, 1986

[51] Int. Cl.[4] ..... F21V 9/00

[52] U.S. Cl. ..... 362/293; 362/281; 362/319; 362/311; 350/315; 350/316

[58] Field of Search ..... 362/231, 233, 250, 311, 362/319, 268, 281, 282; 350/311, 313, 315, 316, 318

[56] References Cited

U.S. PATENT DOCUMENTS

| | | | |
|---|---|---|---|
| 2,627,207 | 2/1953 | Bell | 350/315 |
| 3,538,323 | 11/1970 | Ziegler | 362/293 X |
| 4,037,097 | 7/1977 | Stillman et al. | 350/318 X |
| 4,043,646 | 8/1977 | Heine et al. | 350/315 |
| 4,298,920 | 11/1981 | Gluck et al. | 362/281 |
| 4,392,187 | 7/1983 | Bornhorst | 362/233 |
| 4,488,207 | 12/1984 | Harmon | 362/231 |
| 4,602,321 | 7/1986 | Bornhorst | 362/268 |

*Primary Examiner*—Margaret A. Focarino

*Attorney, Agent, or Firm*—Richards, Harris, Medlock & Andrews

[57] ABSTRACT

A lighting fixture includes a source for producing a beam of light and pair of color wheels. Each of the color wheels has a plurality of dichoric filters mounted on the periphery of the wheel with the filters positioned contiguous to each other. The light beam is directed to a focal point. Each of the color wheels can be rotated to place the peripheral dichroic filters in position to intercept the beam. One of the color wheels is equipped with long wave pass dichroic filters while the other color wheel is equipped with short wave pass dichroic filters. By aligning various combinations of these filters, a large number of different colors with different saturations can be produced. The cutoff wavelengths for the dichoric filters are selected to be different at the long and short wavelengths of the filter set, such that there is produced a perceived uniform graduation of colors across the spectrum. Each of the dichroic filters mounted on the color wheels is in a shape of a trapezoid and is mounted adjacent other filters, such that there is no blanking of light or leakage of light in the process of changing from one filter to the next.

20 Claims, 3 Drawing Sheets

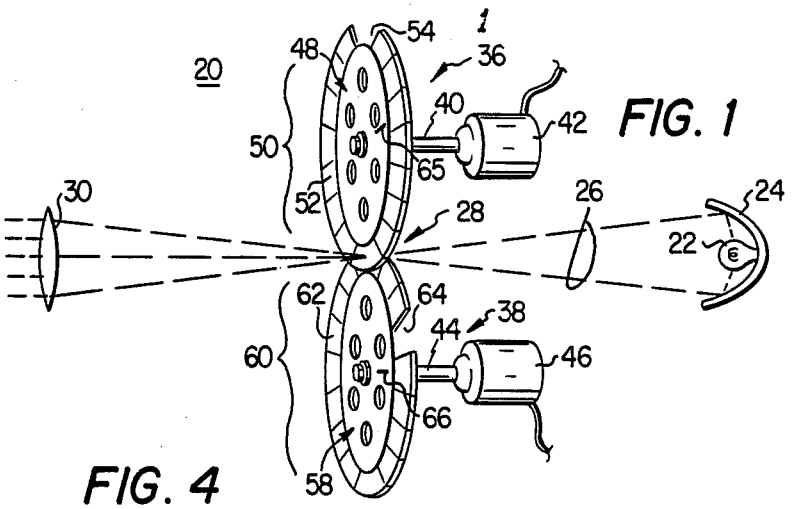
FIG. 1
FIG. 4
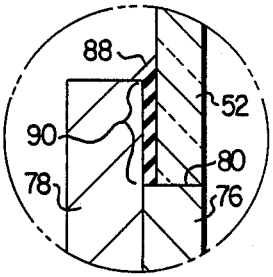
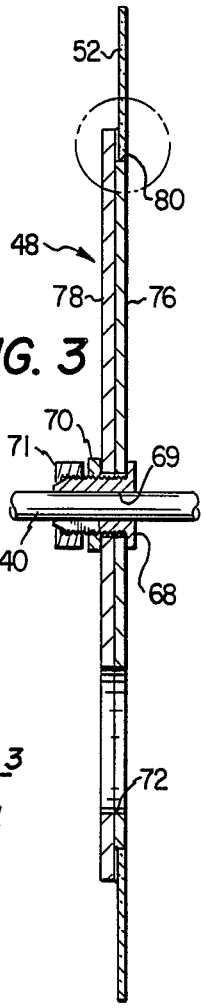
FIG. 3
FIG. 2
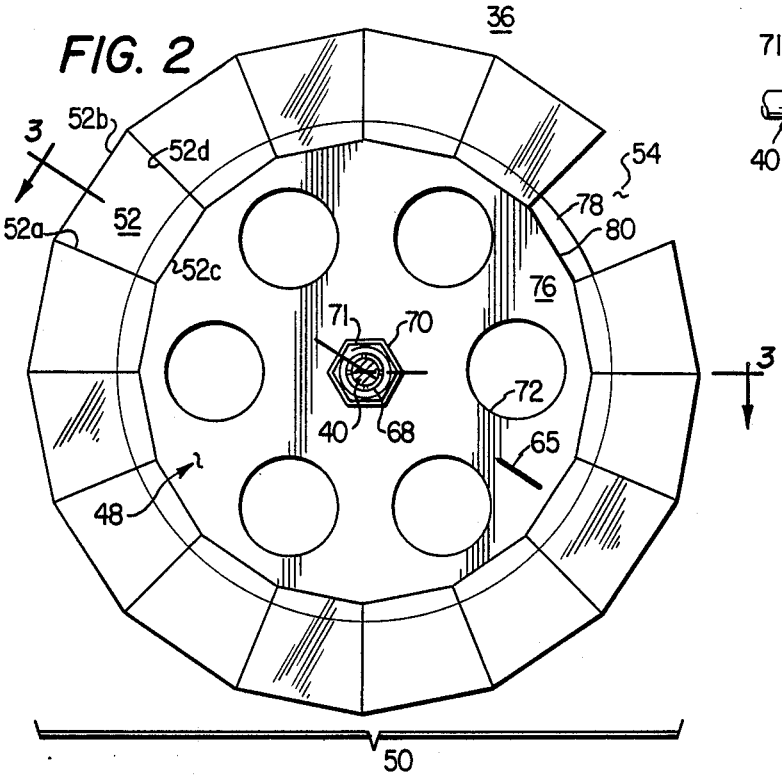

(nm) 400 700

(nm) 400 700

(nm) 400 700

(nm) 400 700

(nm) 400 700

(nm) 400 700

COLOR WHEEL ASSEMBLY FOR LIGHTING EQUIPMENT

TECHNICAL FIELD OF THE INVENTION

The present invention pertains in general to lighting equipment for producing multiple colors of light and in particular to such equipment which employs a rotating color wheel which positions different color filters in a beam of light.

BACKGROUND OF THE INVENTION

Lighting effects have become a major element in theatrical and concert performances. As a result of the demand for elaborate lighting in such performances, sophisticated lighting systems have been developed such as disclosed in U.S. Pat. No. 4,392,187. This system utilizes a computer to control the position, intensity, size and color of the light beams produced by a large number of stage lights.

A particularly important aspect of lighting is that of color. Various colors must be produced by stage lights for working with a large number of scenes and performances, as well as to provide a specific effect which can be done only by a particular color of light. A number of patents have been filed which disclose various methods and apparatus for providing different colors of light. U.S. Pat. No. 3,816,739 discloses a device which provides colors by varying the intensity of red, blue and green light sources. In U.S. Pat. No. 4,319,311 a variety of colors are generated by employing replaceable gelatin color filters in front of the light sources. A further method for providing different colors of light is disclosed in U.S. Pat. No. 4,071,809, in which a color segmented disk is continuously rotated in front of a strobing light which is timed to flash as a certain color passes in front of the lamp. U.S. Pat. No. 4,488,207 discloses a light which has red, yellow and green sources that are angularly disposed with respect to two dichroic filters such that each color can be either transmitted or reflected from the dichroic filters onto an objective lens. Each of the above methods for producing colored light has some drawbacks. In many cases the number of available colors is very limited. The use of gelatin is undesirable as a color filter because the gelatin has a relatively short life. Other techniques require either bulky or complex equipment.

In previously noted U.S. Pat. No. 4,392,187, there are disclosed two techniques for producing colored light. One technique provides dichroic filters in the light beam with means for pivoting the dichroic filters for generating light having different colors. The further technique disclosed in this patent for producing colored light is the use of dichroic filters mounted in color wheels. Each filter is a round member that is mounted in a wheel, with each filter spaced apart from the adjoining filters. These color wheels are rotated such that the light beam can pass through filters in one or both of the color wheels. Although this technique has proven to be successful, it still has drawbacks including difficulty of manufacture, expense and blanking of the light beam when the color wheel is rotated from one filter to another filter.

In view of the above, there exists a need for an inexpensive, reliable color wheel which can be easily manufactured, is compact and easy to use, and does not block the light beam when moving from one filter to the next.

SUMMARY OF THE INVENTION

A selected embodiment of the present invention is a lighting instrument for producing a plurality of colors of light derived from a single light beam. The instrument includes a first rotatable color wheel which has a first set of dichroic filters mounted about the periphery of a hub in which each of the filters in the first set can be selectively positioned in the light beam by rotation of the first color wheel. The first set of dichroic filters comprise long wave pass filters, each of which transmits light having a wavelength greater than the cutoff wavelength of the filter. The cutoff wavelengths of the first set of filters are spaced in the visible spectrum at respective intervals. These intervals are greater at the longer wavelengths than at the shorter wavelengths. A second rotatable color wheel includes a second set of dichroic filters mounted about the periphery of a hub. Each of the filters in the second set can be selectively positioned in the light beam by rotation of the second color wheel. Each of the filters in the first and second sets is positionable such that the light beam can pass sequentially through one filter in the first set and one filter in the second set. The second set of dichroic filters comprises short wave pass filters, each of which transmits light having a wavelength less than the cutoff wavelength of the filter. The cutoff wavelengths of the second set of filters are spaced in the visible spectrum at respective intervals. These intervals are greater at the shorter wavelengths than at the longer wavelengths.

A further embodiment of the present invention is a color wheel for use in a lighting instrument which produces multiple colors of light. The color wheel comprises a hub which is rotatable about the axis thereof and includes a set of planar dichroic filters. Each filter is connected along one edge to the periphery of the hub and extends outward from the hub. A further aspect of the color wheel is that a group of the filters are positioned contiguous to other filters on the hub, such that there is no interruption of light in transferring from one filter to the next and there is virtually no leakage of unfiltered light between the filters.

A still further aspect of the present invention is the configuration of the dichroic filters mounted on the periphery of the hub of each color wheel. Each filter is in the shape of a trapezoid, such that a set of filters forms an annular ring on the color wheel.

BRIEF DESCRIPTION OF THE DRAWINGS

For a more complete understanding of the present invention and the advantages thereof, reference is now made to the following Description taken in conjunction with the accompanying Drawings in which:

FIG. 1 is a perspective view of a lighting instrument having two rotatable color wheels which can have filters selectively positioned within a beam of light;

FIG. 2 is an elevation view of a color wheel having a plurality of dichroic filters mounted around the periphery of a hub;

FIG. 3 is a sectional view of the color wheel shown in FIG. 2 taken along lines 3—3;

FIG. 4 is an enlarged section view taken of portion 4 of the color wheel shown in FIG. 3 for illustrating the bonding of a dichroic filter to the hub of a color wheel;

DETAILED DESCRIPTION OF THE INVENTION

Figure 15:
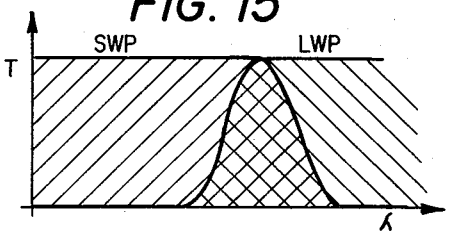
FIGS. 13–15 illustrate the resulting colored light spectrum produced by passing the original light beam sequentially through both a long wave pass and a short wave pass filter.

A first embodiment of the present invention is illustrated in FIG. 1 as a lamp assembly 20 which comprises a lighting instrument. A bulb 22 produces light which is focused by an elliptic reflector 24 into a light beam 26. At a location 28, the light beam 26 is concentrated at a focal point by the reflector 24. Beyond the location 28, the beam 26 expands and is captured by a converging lens 30 which converts the beam 26 into a substantially parallel beam of light.

The lamp assembly 20 further includes a first color wheel 36 and a second color wheel 38. Wheel 36 is mounted on a shaft 40 which is directly driven by a stepper motor 42. The color wheel 38 is mounted on a shaft 44, which is in turn driven by a stepper motor 46.

The color wheel 36 comprises a hub 48 and a set 50 of planar dichroic filters, such as a filter 52, which are mounted on the periphery of the hub 48. An open position 54 is provided on the periphery of the hub 48 to permit the beam 26 to pass through the color wheel without alteration. The dichroic filters, such as 52, as well as the position 54 are rotatable by the motor 42 into the location 28 at the focal point of the beam 26, such that any filter in the set, or the open position, can be placed at this location to alter the color of the beam or to pass the beam unaltered.

Color wheel 38 likewise includes a hub 58 having mounted on the periphery thereof a set 60 of planar, dichroic filters, such as a filter 62. Wheel 38 also includes an open position 64 for permitting the light beam 26 to pass through the color wheel 38 without alteration. The color wheel 38 rotates in response to operation of the stepper motor 46 to position any one of the dichroic filters mounted on the hub 58 into the location 28 for altering the color of the beam 26.

Wheel 36 is provided with a reference black stripe 65 and wheel 38 with a similar reference stripe 66. These stripes are used by optical control equipment, not shown, for determining the orientation of the color wheels when the assembly 20 is first activated.

The color wheels 36 and 38 are fabricated in essentially the same manner. For hubs 48 and 58 having a diameter of 5 inches, there is space for 15 filters. The difference between the two color wheels 36 and 38 is in the transmittance and reflectance characteristics of the dichroic filters mounted on each of the wheels. The specific characteristics of the various color filters for each color wheel is further described in reference to FIG. 6 below.

The color wheel 36 is illustrated in a detailed elevation view shown in FIG. 2. A section view of the wheel 36 is illustrated in FIG. 3. A collet 68 is threaded to a central opening in the hub 48. Collet 68 has a hex head which prevents the collet from passing through the hub 48. Collet 68 has a cylindrical opening 69 which receives the shaft 40. The end of the collet 68 opposite the head is slotted.

The collet 68 is secured to the hub 48 by a nut 70. After the shaft 40 is positioned within the opening 69, a nut 71 is applied to the slotted portion of collet 68 to clamp the collet 68 to the shaft 40.

The hub 48, which is preferably fabricated of aluminum, is provided with a plurality of openings, such as 72, for reducing the weight of the color wheel. The combination of the light metal and the multiple openings 72 serves to reduce the mass, and therefore the inertia, of the color wheel 36. The reduced inertia of the color wheel 36 allows the wheel to be accelerated, moved and stopped faster and with less power than such a wheel having greater weight and inertia.

The hub 48 comprises two laminated aluminum plates 76 and 78. The difference in the diameters of the two round plates 76 and 78 forms a step 80 which, is located on the periphery of the hub 48. Plate 76 has a plurality of flat peripheral sections, each for receiving one of the filters in the set 50.

All of the filters within the filter set 50, as well as the filter set 60, have the same size and configuration. Each of the filters is in the shape of a trapezoid. Referring to FIG. 2, the filter 52 has linear sides 52*a*, 52*b*, 52*c* and 52*d*. The sides 52*b* and 52*c* are parallel. Each of the sides 52*a* and 52*d* is aligned with a line which passes through the center of the wheel 36. Thus, each of the filters, such as 52, is in the shape of a trapezoid which is symmetrical about an axis extending from the center of the wheel 36 outward through the center of the filter.

In a selected embodiment the edges 52*a* and 52*d* are 1.05 inches long, the edge 52*c* is 0.70 inch long and the edge 52*b* is 1.10 inches long.

The trapezoidal shape of the filters within the set 50 is particularly advantageous in the manufacture of the filters. Each filter is cut from a larger sheet of pyrex glass which has been coated with appropriate materials to give the proper color transmission and reflectance. The larger sheet of glass is scribed along lines to give the proper dimensions for the resulting filter, such as 52. The scribed lines are easily broken to form each of the individual filters. Previously, such filters have been manufactured in a circular shape which required cutting the glass sheet with a core saw. Filters made in the previous manner result in a substantial waste of the original glass sheet and are more subject to breakage, due to the formation of microfractures around the edges of the circular filter. Such fractures are much less likely to occur when the glass sheet is cut with a straight scribe line. Thus, the trapezoidal dichroic filters in accordance with the present invention are easier to manufacture, have less waste in the manufacturing process and are less subject to breakage in use.

As a result of the uniform trapezoidal shape of the filters within the set 50, the filters as a whole form an annular ring about the hub 48, with the only opening being the open position 54.

Each of the filters in the set 50, such as filter 52, is mounted on the periphery of the hub 48 and is positioned on the step 80. Each filter in set 50 is bonded to the hub 48 and the filter is directed radially outward from the center of the hub 48. Each of the filters is bonded by an adhesive film 88. The step 80 serves primarily as a register to assure the proper positioning of each of the filters within the set 50. The film 88 is located principally between the filter, such as 52, and the metal plate 78 of the hub 48. This is illustrated in detail in FIG. 4. The principal bonding between the filter 52 and the plate 78 is in the region marked by the reference numeral 90. The bonding extends along the lower edge of the filter 52.

The adhesive which bonds the dichroic filters to the hub 48 is preferably RTV silicon rubber which is manufactured by both General Electric and DuPont. The resilient bond, film 88, between the glass filter, such as 52, and the aluminum plate 78 has several advantages, in addition to providing a joining between the two members. This adhesive provides a resilient mount for the glass filter which reduces the possibility of cracking the filter when the filter is subjected to stress. The flexible bond also compensates for the differences in the coefficients of expansion between the aluminum plate 78 and the glass filter 52. Each of the filters in the set 50 is subjected to substantial heating, as is the hub 48. The color wheel 36 must be able to function properly, without failure, from room temperature up to approximately 200° C. The RTV silicon rubber can withstand this temperature range.

Further referring to the color wheel 36 shown in FIG. 2, note that the filters are contiguous to each other along their lateral edges, with the exception of the filters adjacent the open position 54. This configuration of filters provides unique advantages for the color wheel 36 over previous color wheels. Conventional color filters are mounted in a wheel with each filter separated by the body of the wheel which acts to block the light from the lamp when the wheel is rotated from one filter to the next. But when the color wheel 36 is rotated from one filter to the next filter, there is no blocking of the light produced by the lamp assembly 20. There is essentially no change in the intensity of the light, but only a change in its color. This eliminates the distracting blanking that can occur with conventional stage lamps when there is a change from one color filter to the next. The contiguous positions of the filters also prevents the leakage of light between filters which would occur if the filters were offset from each other on the filter wheel. Should intense white light be permitted to leak between the filters, there would be created an unwanted and distracting bright flash in the lighting display.

Figure 5:
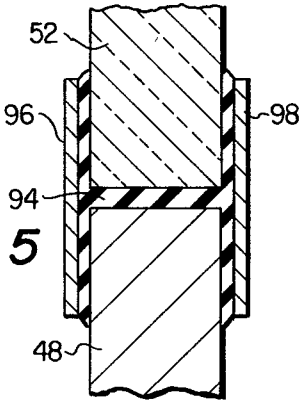
FIG. 5 is a sectional view illustrating an alternative embodiment for joining the dichroic filters to the hub of a color wheel.

Referring now to FIG. 5, there is illustrated an alternative embodiment for mounting the dichroic filters in the set 50 to the hub 48. Filter 52 is butted against the outer edge of the hub 48. In this embodiment the aluminum plate 78 is optional. An adhesive film 94 is applied between the filter 52 and the plate 76. It is also applied on the immediately adjoining front and back planar surfaces of both the filter 52 and the plate 76. Thus, the adhesive film in cross section is in the shape of an H. Annular rings 96 and 98 are applied on opposite sides of the junction between the filter 52 and the plate 76 to hold the two members in place relative to each other and provide proper alignment for the filter 52.

The dichroic filters in the sets 50 and 60 are preferably manufactured of pyrex glass having a thickness of approximately 0.040 inch. Dichroic filters of this type are available from Technical Products Division of Optical Coating Laboratory, Inc., Santa Rosa, Calif. The transmittance and reflectance characteristics of each dichroic filter is determined by depositing various layers of material on the pyrex glass in a vacuum chamber. The method of producing such dichroic filters having predetermined spectral response characteristics is well known in the art.

The filters within the sets 50 and 60 are arranged about the respective color wheels 36 and 38 in an order from lighter shades to darker shades. Thus, as the wheels are rotated, there is a smooth transition of colors with gradual steps rather than transmitting spurious colors during a color change.

Figure 6:
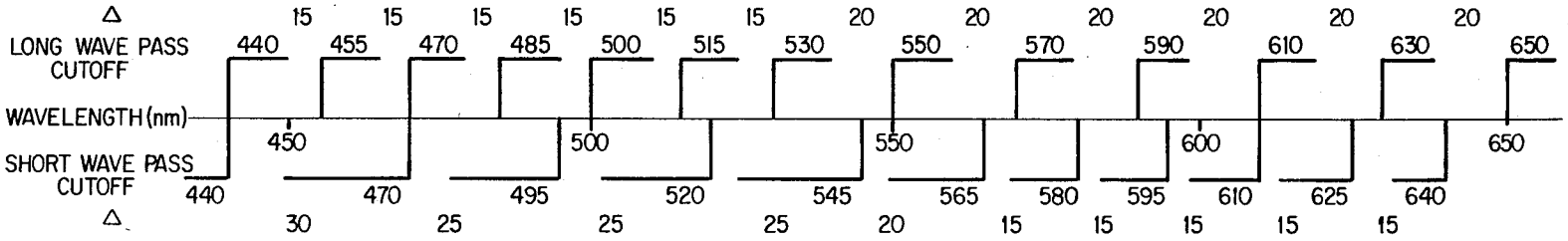
FIG. 6 is a chart illustrating the cutoff frequencies for the long wave pass and short wave pass dichroic filters implemented in the disclosed embodiment of the color wheel of the present invention.

Referring now to FIG. 6, there is illustrated a set of spectral characteristics for the filters within set 50 and set 60. In a preferred embodiment of the present invention, the filters within set 50 are primarily long wave pass (LWP) filters and the filters in set 60 are primarily short wave pass (SWP) filters. An LWP filter transmits light having a wavelength greater than the filter's cutoff or edge wavelength. Light having a wavelength less than the cutoff wavelength of the filter is reflected. A SWP filter transmits light having a wavelength less than the cutoff wavelength of the filter and reflects the light which has a greater wavelength than the cutoff wavelength of the filter.

The intervals between cutoff wavelengths are shown as $\Delta$ values above the long wave pass cutoff wavelengths and below the short wave cutoff wavelengths.

When a filter in the set 50 is aligned with a filter in the set 60, such that the light beam 26 passes through both filters, there can be selected a desired center wavelength and bandwidth for the light to be transmitted from the lamp assembly 20. This defines the color and saturation for the resulting light. By rotating the wheels 36 and 38 to different positions, a large number of combinations of center wavelength and bandwidth can be selected to achieve a wide range of colors, as well as desired saturation for each color. As an example, assume that the filter 52 in wheel 36 is aligned with the filter 62 in wheel 38. If filter 52 has a long wave pass cutoff of 500 nm and the filter 62 has a short wave pass cutoff of 545 nm, then the resulting light transmitted through the combination of the two filters will have a center wavelength of approximately 522 nm and a bandwidth of 45 nm. Any one of the filters in the sets 50 and 60 can be utilized as a single filter by aligning the open position in the other color wheel at the location 28. White light can be transmitted by aligning both of the open positions 54 and 64 to location 28.

A significant feature of the present invention is the spacing of the cutoff frequencies for the dichroic filters. Prior art dichroic filter sets have spaced the cutoff wavelengths at even increments across the spectrum. It has been discovered that this does not provide desirable lighting control. Specifically, it does not provide uniform steps of perceived color changes across the spectrum. For uniform filter cutoff spacings, the perceived effect of changes for long wave pass filters is greater at shorter wavelengths than at longer wavelengths. The inverse is true for short wave pass filters, the perceived effect is much greater at longer wavelengths than at shorter wavelengths. It has been determined that nonuniform spacing of cutoff wavelengths across the spectrum can provide a more uniform perceived effect. Therefore, in accordance with the present invention, the spacing of the cutoff wavelengths is different at the higher and lower wavelengths for both the long wave pass and the short wave pass filters. For the long wave pass filters, the spacing between filter cutoffs is less at the shorter wavelengths and greater at the longer wavelengths. For the short wave pass filters, the spacing is greater at the short wavelengths and less at the longer wavelengths. The result of this particular nonuniform spacing of cutoff wavelengths is that the perceived effect is an evenly scaled set of color values. This gives lighting designers the capability of producing detailed color shadings to create the effects that they desire. Previous color filter systems have not been able to provide the uniformity of color graduations required by lighting designers.

Figure 7:
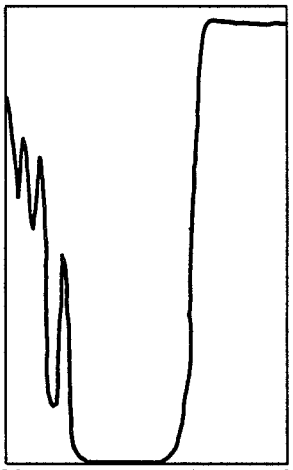
FIGS. 7–12 are illustrations of the spectral response characteristics for dichroic filters having complex color characteristics.
Figure 8:
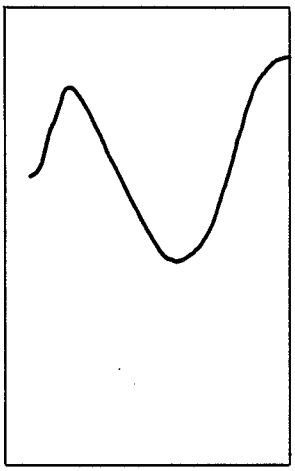
Figure 9:
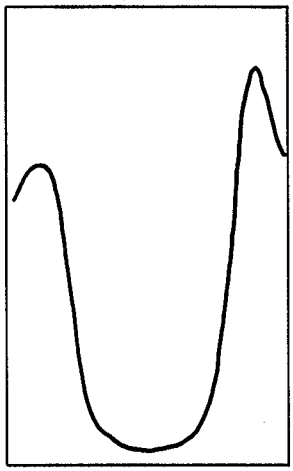
Figure 10:
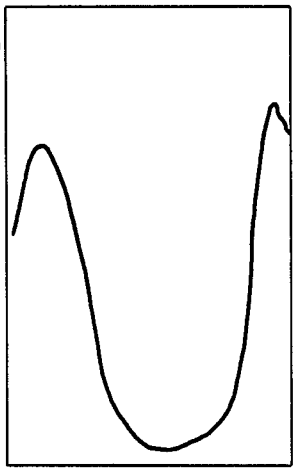
Figure 11:
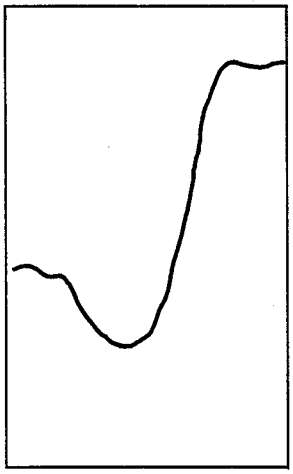
Figure 12:
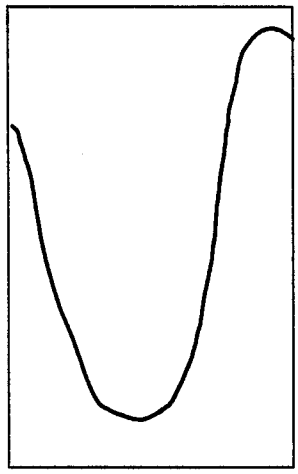

A still further aspect of the present invention is the use of complex color filters (CCF). The characteristic representative ones of these filters are shown in FIGS. 7–12. Each of these charts represents the normalized response of a CCF across the visible spectrum of 400–700 nm. The color produced by each of these filters is described as follows:

FIG. 7—Medium Magenta
FIG. 8—Light Lavender
FIG. 9—Rose Pink
FIG. 10—Deep Lavender Blue
FIG. 11—Amber Peach
FIG. 12—Bright Rose Pink These complex color filters can be mounted on one or both of the color wheels to interact with either the LWP, SWP or other CCF filters.

The results produced by combining various LWP and SWP filters as well as CCF filters is illustrated in FIGS. 13–16.

Figure 13:
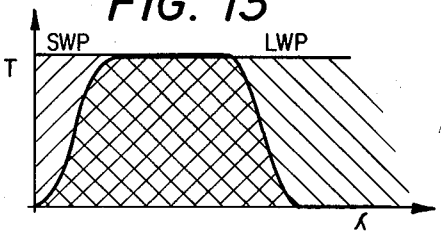

FIG. 13 illustrates the combination of a short wave pass filter and a long wave pass filter which are respectively selected from sets 50 and 60 and simultaneously positioned at the location 28. The pass band of each filter is shown by single hatching and the resulting pass band is shown by the combined area illustrated by the double hatching.

Figure 14:
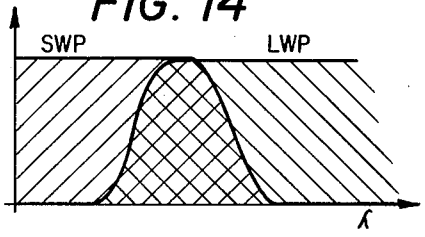

FIG. 14 illustrates another combination of a SWP and a LWP filter with less overlap between the two filters. This results in the production of a color which is more saturated.

FIG. 15 illustrates a further combination of a SWP and a LWP filter but with the center wavelength of the filter shifted to a longer wavelength portion of the spectrum. Again, the double hatched area is the portion of the spectrum which is transmitted from the lamp assembly 20.

Figure 16:
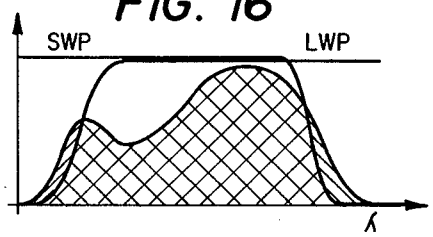
FIG. 16 is an illustration of the resulting colored light spectrum produced when the original light beam is passed sequentially through either a short or long wave pass filter and a complex color filter.

FIG. 16 is an illustration of the combination of a CCF with either a SWP or a LWP filter. The SWP and LWP filters are mounted on both of the color wheels 36 and 38. Therefore, the complex color filter can be used with either a short wave pass or a long wave pass filter on the other wheel. When the CCF is combined with a SWP, a portion of energy that would normally be passed by the CCF is blocked. This portion of energy is at the long wave portion of the CCF filter. But if a LWP filter is used with the CCF, portions of the shorter wavelengths can be removed from the CCF to change the shading of the complex color produced by the CCF. In FIG. 16, the reflected portions of the CCF spectrum are shown with single hatching. The capability of subtracting various high or low wavelengths of the CCF spectrums substantially increases the number and variety of colors which can be produced by the lamp assembly 20 of the present invention.

In summary, the present invention comprises lighting apparatus which provides a very wide variety of light colors with evenly spaced graduations in color. The color wheel of the present invention further eliminates the problems of blanking or leaking of light during changes of color filters and has reduced inertia for rapid movement. In a still further aspect, the present invention provides a unique configuration for a dichroic filter, namely a trapezoidal shape.

Although several embodiments of the invention have been illustrated in the accompanying drawings and described in the foregoing Detailed Description, it will be understood that the invention is not limited to the embodiments disclosed, but is capable numerous rearrangements, modifications and substitutions without departing from the scope of the invention.

What I claim is:

1. A lighting instrument for producing a plurality of colors of light from a light source which produces a light beam, comprising:

a first rotatable color wheel comprising a first set of dichroic filters mounted about the periphery of a hub wherein each of said filters in said first set can be selectively positioned in said light beam by rotation of said first color wheel, said first set of dichroic filters comprising long wave pass filters each of which transmits light having a wavelength greater than a cutoff wavelength of the filter, the cutoff wavelengths of said first set of filters spaced in the visible spectrum at respective intervals, said intervals being greater at longer wavelengths than at shorter wavelengths, a second rotatable color wheel comprising a second set of dichoric filters mounted about the periphery of a hub wherein each of said filters in said second set can be selectively positioned in said light beam by rotation of said second color wheel, wherein said filters are positioned such that said light beam can pass sequentially through one filter in said first set and one filter in said second set, and said second set of dichroic filters comprising short wave pass filters each of which transmits light having a wavelength less than a cutoff wavelength of the filter, the cutoff wavelengths of said second set of filters spaced in the visible spectrum at respective intervals, said intervals being greater at shorter wavelengths than at longer wavelengths.

2. A lighting instrument as recited in claim 1 wherein each of said filters is joined along one edge thereof to the periphery of the respective one of said hubs wherein each of said filters is directed outward from the respective hub.

3. A lighting instrument as recited in claim 1 wherein each of a plurality of said filters is positioned contiguous to others of said filters in said set.

4. A lighting instrument as recited in claim 1 wherein each of said filters has a trapezoidal shape and only one edge of each said filter is connected to the respective hub.

5. A lighting instrument as recited in claim 1 wherein the filters in each of said sets comprise a substantially closed annular ring about the respective hub.

6. A lighting instrument as recited in claim 1 wherein the filters in each of said sets are arranged about the respective hubs in an order from lighter color shades to darker color shades.

7. A lighting instrument as recited in claim 1 wherein each of said filters has a shape with all sides linear.

8. A lighting instrument for producing a plurality of colors of light from a light source which produces a light beam, comprising:

a first rotatable color wheel comprising a first set of dichroic filters mounted about the periphery of a hub wherein each of said filters in said first set can be selectively positioned in said light beam by rotation of said first color wheel, said first set of dichroic filters comprising long wave pass filters each of which transmits light having a wavelength greater than a cutoff wavelength of the filter, the cutoff wavelengths of said first set of filters spaced in the visible spectrum at respective intervals, said intervals being greater at longer wavelengths than at a shorter wavelengths, a second rotatable color wheel comprising a second set of dichroic filters mounted about the periphery of a hub wherein each of said filters in said second set can be selectively positioned in said light beam by rotation of said second color wheel, wherein said filters are positioned such that said light beam can pass sequentially through one filter in said first set and one filter in said second set, said second set of dichroic filters comprising short wave pass filters, each of which transmits light having a wavelength less than a cutoff wavelength of the filter, the cutoff wavelengths of said second set of filters spaced in the visible spectrum at respective intervals, said intervals being greater at shorter wavelengths than in longer wavelengths, and each of said hubs comprising first and second plates having different diameters and coaxially joined together to form a step on the periphery of the hub, said step for receiving said filters.

9. A lighting instrument as recited in claim 1 wherein each of said filters is banded to the respective hub by a resilient adhesive.

10. A color wheel for use in a lighting instrument for producing multiple colors of light, said lighting instrument generating a beam of light, comprising:

a hub rotatable about the axis thereof, said hub having a periphery, an annular ring shaped area being defined radially outward of the periphery, the beam of light passing through the annular ring at a first position, and a set of planar dichroic filters, each filter joined along one edge thereof to the periphery of said hub and extending outward from said hub and across a predetermined arc of the annular ring shaped area, the predetermined arc for each filter being sufficient for the entire beam to pass through a given filter at the first position, each of a plurality of said filters is positioned contiguous to other filters in said set so that the beam is unimpeded by the hub as the hub rotates about the axis to place a filter at the first position.

11. A color wheel as recited in claim 10 wherein each of the plurality of said filters is positioned between the other filters in said set.

12. A color wheel as recited in claim 10 wherein said filters form a substantially closed annular ring encircling said hub.

13. A color wheel as recited in claim 10 wherein each of said filters has a shape with all sides linear.

14. A color wheel as recited in claim 10 wherein each of said filters has a trapezoidal shape.

15. A color wheel for use in a lighting instrument for producing multiple colors of light, comprising:

a hub rotatable about the axis thereof, a set of planar dichroic filters, each filter joined along one edge thereof to the periphery of said hub and extending outward from said hub, and said hub comprising first and second plates having different diameters and coaxially joined together to form a step on the hub, said step for receiving said filters.

16. A color wheel as recited in claim 10 wherein each of said filters is bonded to said hub by a resilient adhesive.

17. A filter for coloring a light beam comprising a planar glass plate having deposited layers thereon for selectively passing and reflecting spectral portions of said light beam, said plate having a trapezoidal configuration.

18. A filter as recited in claim 17 wherein the nonparallel sides of said filter are of equal length.

19. A filter as recited in claim 17 wherein said filter is symmetrical about a center axis.

20. A lighting instrument for producing a plurality of colors of light from a light source which produces a light beam, comprising:

a first rotatable color wheel comprising a first set of dichroic filters mounted about the periphery of a hub wherein each of said filters in said first set can be selectively positioned in said light beam by rotation of said first color wheel, said first set of dichroic filters comprising at least one complex color filter, a second rotatable color wheel comprising a second set of dichroic filters mounted about the periphery of a hub wherein each of said filters in said second set can be selectively positioned in said light beam by rotation of said second color wheel, wherein said filters are positioned such that said light beam can pass sequentially through one filter in said first set and one filter in said second set, and said second set of dichroic filters comprising at least one long wave pass filter which transmits light having a wave length greater than a cutoff wave length of the filter, and at least one short wave pass filter which transmits light having a wave length less than a cutoff wave length of the filter.

* * * * *